US011622203B2

(12) United States Patent
Noergaard

(10) Patent No.: US 11,622,203 B2
(45) Date of Patent: Apr. 4, 2023

(54) METHOD OF FITTING A HEARING AID SYSTEM AND A HEARING AID SYSTEM

(71) Applicant: Widex A/S, Lynge (DK)

(72) Inventor: Peter Magnus Noergaard, Denmark (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 17/252,076

(22) PCT Filed: Jun. 13, 2019

(86) PCT No.: PCT/EP2019/065438
§ 371 (c)(1),
(2) Date: Dec. 14, 2020

(87) PCT Pub. No.: WO2019/238801
PCT Pub. Date: Dec. 19, 2019

(65) Prior Publication Data
US 2021/0258701 A1 Aug. 19, 2021

(30) Foreign Application Priority Data
Jun. 15, 2018 (DK) ..... PA201800280

(51) Int. Cl.
*H04R 25/00* (2006.01)
*H04R 29/00* (2006.01)

(52) U.S. Cl.
CPC ..... *H04R 25/30* (2013.01); *H04R 25/70* (2013.01); *H04R 2225/55* (2013.01)

(58) Field of Classification Search
CPC ..... H04R 25/00
USPC ..... 381/60, 312
See application file for complete search history.

(56) References Cited

U.S. PATENT DOCUMENTS 8,050,435 B2 * 11/2011 Nishizaki ..... H04R 25/70 381/60
8,744,103 B2 * 6/2014 Ma ..... H04R 25/70 381/317
2009/0154741 A1 6/2009 Woods et al.
2010/0104122 A1 4/2010 Waldmann
2012/0183164 A1 7/2012 Foo et al.
2016/0350821 A1 12/2016 Shennib et al.
2017/0055090 A1 2/2017 Gran et al.
2021/0106827 A1 * 4/2021 Chalupper ..... A61N 1/36039

FOREIGN PATENT DOCUMENTS

EP 2 160 923 B1 9/2011
EP 2 454 891 B1 2/2014
EP 3 331 254 A1 6/2018
WO 03/007655 A1 1/2003
(Continued)

OTHER PUBLICATIONS

Danish Search Report for 2018 00280 dated Nov. 8, 2018.
(Continued)

*Primary Examiner* — Suhan Ni
(74) *Attorney, Agent, or Firm* — Sughrue Mion, PLLC

(57) ABSTRACT

A method (300) of fitting a hearing aid system, based on the use of hearing aid system setting data and data related to a possible hearing aid system performance verification for a multitude of different hearing aid system users, as well as a hearing aid system adapted to carry out such a method.

8 Claims, 4 Drawing Sheets

(56) References Cited

FOREIGN PATENT DOCUMENTS

| | | | |
|---|---|---|---|
| WO | 2006/058453 | A2 | 6/2006 |
| WO | 2012/076045 | A1 | 6/2012 |
| WO | 2016/004983 | A1 | 1/2016 |
| WO | 2016/058637 | A1 | 4/2016 |
| WO | 2016/095987 | A1 | 6/2016 |
| WO | 2017/059881 | A1 | 4/2017 |
| WO | 2018/006979 | A1 | 1/2018 |

OTHER PUBLICATIONS

International Search Report for PCT/EP2019/065438 dated Oct. 16, 2019 (PCT/ISA/210).
Written Opinion of the International Searching Authority for PCT/EP2019/065438 dated Oct. 16, 2019 (PCT/ISA/237).

* cited by examiner

METHOD OF FITTING A HEARING AID SYSTEM AND A HEARING AID SYSTEM

The present invention relates to a method of fitting a hearing aid system. The present invention also relates to a hearing aid system adapted to carry out said method.

BACKGROUND OF THE INVENTION

Generally, a hearing aid system according to the invention is understood as meaning any device which provides an output signal that can be perceived as an acoustic signal by a user or contributes to providing such an output signal, and which has means which are customized to compensate for an individual hearing loss of the user or contribute to compensating for the hearing loss of the user. They are, in particular, hearing aids, which can be worn on the body or by the ear, in particular on or in the ear, and which can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context, a traditional hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context, a hearing aid system may comprise a single hearing aid (a so-called monaural hearing aid system) or comprise two hearing aids, one for each ear of the hearing aid user (a so-called binaural hearing aid system). Furthermore, the hearing aid system may comprise an external device, such as a smart phone having software applications adapted to interact with other devices of the hearing aid system. Thus within the present context the term "hearing aid system device" may denote a hearing aid or an external device.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the car. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids, a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

It is well known within the art of hearing aid systems that most users will benefit from a hearing aid programming (this process may also be denoted fitting) that takes the user's personal preferences or the specific sound environments that the user encounters into account. This type of fine tuning or optimization of the hearing aid system settings may also be denoted fine tuning. It is however also well known that the process of fine tuning is a very challenging one.

One problem with fine tuning is that it may be very difficult for a user to explain in words what types of signal processing and the corresponding sound that are preferred.

Another problem is that fine tuning in some cases preferably are carried out by the user himself after the initial fitting in order to take into account specific sound environments encountered by the user or due to changes in the users preferences or cognitive skills.

Fine tuning may generally be advantageous with respect to basically all the various types of signal processing that are carried out in a hearing aid system. Thus fine tuning may be relevant for e.g. noise reduction, optimization of listening comfort as well as for classification of the sound environment.

However, if a hearing aid system suffers from some form of defect, due to e.g. component failure, the user may be unaware of this defect and seek to improve the hearing aid system performance through fine tuning, which may be a very frustrating and typically fruitless experience for the user.

It has therefore been suggested in the art to provide a hearing aid with self-test capability so that a defect in a hearing aid can be signaled to the user. WO-A1-03007655 discloses such a hearing aid and a corresponding method for verifying the functioning of the hearing aid.

Recently it has also been suggested to apply various forms of machine learning techniques to improve e.g. the first fitting of an individual user based on the hearing aid system fittings selected by other users. WO-A1-2006058453 is one example of such a method, wherein a personality vector of an individual user is compared to a multitude of stored personality vectors representing other users, and wherein a fitting vector representing a specific hearing aid system setting is assigned to each of said stored such personality vectors, whereby the individual user may use the fitting vector that is assigned to the stored personality vector that is most similar to the personality vector of the individual user.

However, these methods generally face a potential challenge with respect to dealing with the fact that some of the hearing aid system fittings selected by users may be due to hearing aid defects that the user is unaware of.

It is therefore a feature of the present invention to provide an improved method of fitting a hearing aid system.

It is another feature of the present invention to provide a hearing aid system adapted to provide such a method.

SUMMARY OF THE INVENTION

The invention, in an aspect, provides a method of fitting a hearing aid system.

The invention, in another aspect, provides a hearing aid system.

The invention in yet another aspect, provides a non-transitory computer-readable medium.

The invention still another aspect, provides an internet server.

Further advantageous features appear from the disclosure below.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

In the present context the terms microphone and acoustical-electrical input transducer may be used interchangeably. Further, in the context of describing the process where a hearing aid system setting (i.e. the variable hearing aid system parameters) is changed, the terms fitting and programming may be used interchangeably with the term changing.

Figure 1:
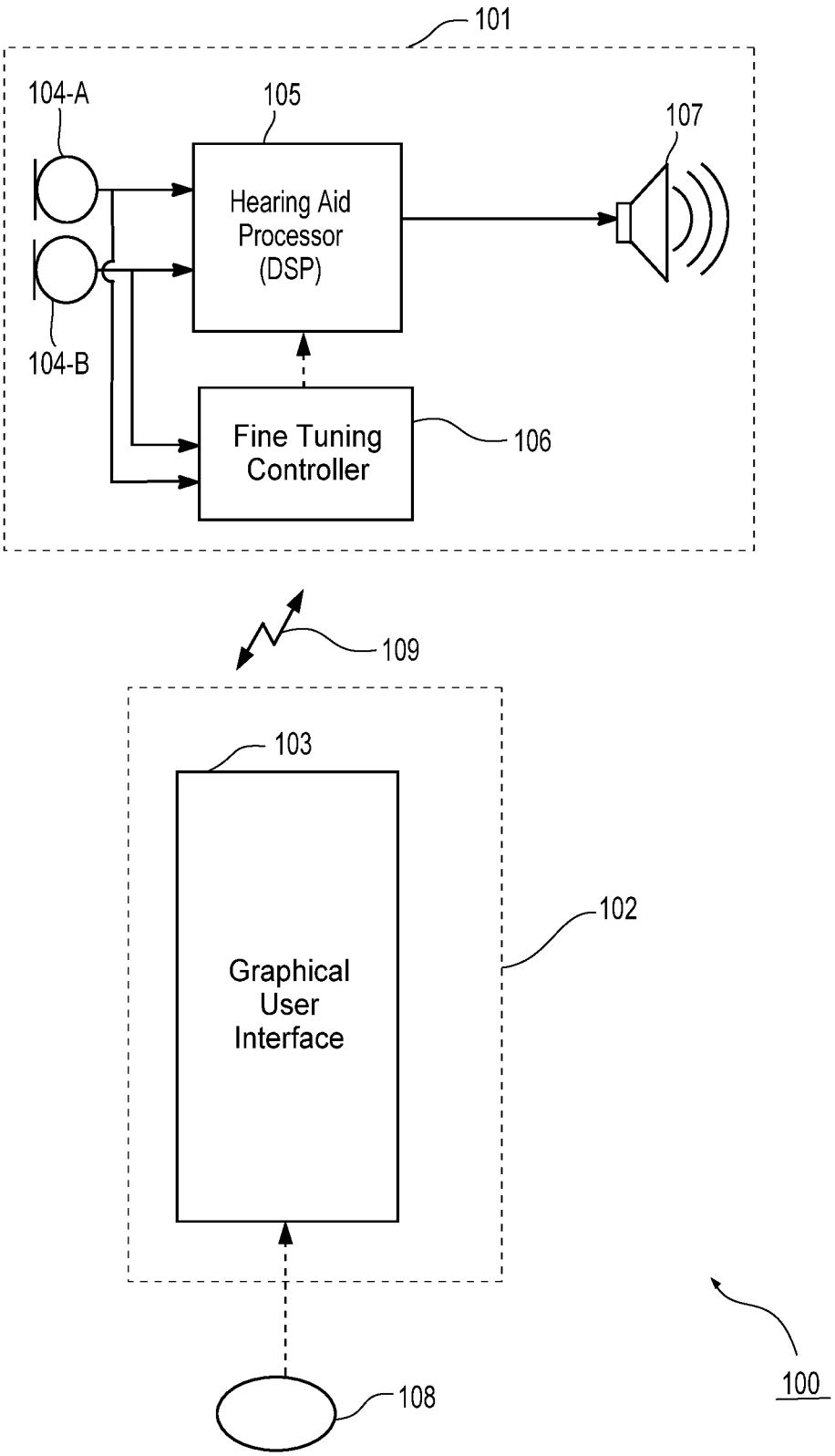
FIG. 1 illustrates highly schematically a hearing aid system according to an embodiment of the invention.

Reference is now made to FIG. 1, which illustrates highly schematically a hearing aid system 100 according to an embodiment of the invention. The hearing aid system 100 comprises a hearing aid 101 and an external device 102. The hearing aid 101 comprises two acoustical-electrical input transducers (104-A and 104-B), a digital signal processor (DSP) 105, a fine tuning controller 106 and an electrical-acoustical output transducer 107. The external device 102 comprises a user interaction device in the form of a graphical user interface 103.

The digital signal processor 105 comprises settings configured to apply a frequency dependent gain that is adapted to at least one of suppressing noise, enhancing a target sound, customizing the sound to a user preference and alleviating a hearing deficit of a user wearing the hearing aid system 100.

In the present context changes to the settings of the digital signal processor may be denoted fine tuning.

The inventors have found that improved hearing aid user satisfaction may be achieved if the hearing aid system (100) is adapted to only allow changes to at least some of the digital signal processor settings if a hearing aid performance verification is carried out with a successful result (i.e. without detecting any defects) before any fine tuning is carried out.

The fine tuning controller 106 is adapted to carry out the fine tuning and as part here of control a hearing aid performance verification in response to a received trigger signal, wherein the trigger signal is received from a graphical user interface 103 accommodated in the external device 102: However according to variations the graphical user interface 103 may be replaced by some other form of user interaction devices, such as a push button or a control wheel, accommodated in the hearing aid 101.

In the present context a received trigger signal may also be denoted a request.

The graphical user interface 103 is configured to allow a hearing aid system user 108 to fine tune (i.e. to change) a number of digital signal processor parameters (i.e. the settings) to personal preferences and to transmit a request to carry out the fine tuning of the hearing aid 101 from the external device 102 and to the fine tuning controller 106 of the hearing aid 101 using a wireless link 109. According to specific variations the fine tuning carried out by the hearing aid system user comprises use of Bayesian methods for suggesting improved parameter settings. One such Bayesian method is disclosed in WO-A1-2016004983. According to further variations the fine tuning carried out by the hearing aid system user, using the graphical user interface, comprises use of various methods and corresponding processing resources accommodated on a remote server that is accessed using the external device 102 and in still further variations the external device 102 operates as gateway between the remote server and the hearing aid 100 when transmitting the new digital signal processor settings from the remote server and to the hearing aid 101.

In the present context the terms remote server and internet server may be used interchangeably.

When the fine tuning controller 106 receives a trigger signal, a hearing aid performance verification is carried out in response hereto and the verification will include at least one of a feedback test, an ear piece positioning test, an ear wax congestion test, microphone performance test and a receiver distortion test, wherein the verification is carried out using corresponding circuitry in the hearing aid system.

According to an advantageous variation the fine tuning controller (106) is configured to carry out a hearing aid feedback test before carrying out at least one of a wax congestion detection and microphone performance test; and wherein the fine tuning controller (106) is further configured to not carrying out at least one of the wax congestion detection and the microphone performance test if a result of the feedback test is within a range of expected values. Hereby a minimum of performance testing will be required because a wax congestion detection and microphone performance test will normally not be required if the result of the feedback test is within the range of expected values.

According to one specific variation a feedback test is carried out wherein the filter coefficients of the adaptive feedback suppression filter is determined based on a calculation as opposed to prior art methods that rely on allowing an adaptive feedback suppression filter to adapt in response to a provided audio test signal until a convergence criterion is fulfilled, and then using the resulting filter coefficients as the result of the feedback test. Hereby a very fast feedback test is provided.

Figure 2:
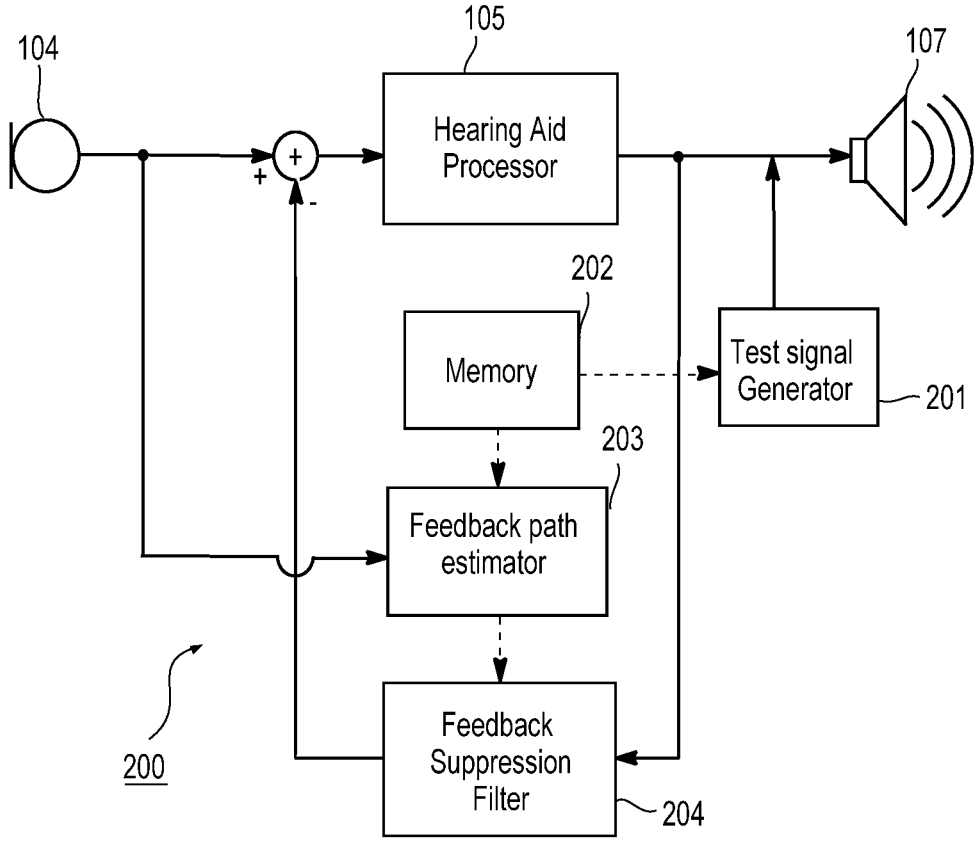
FIG. 2 illustrates highly schematically a hearing aid.

Reference is now given to FIG. 2, which illustrates the components required to carry out the fast feedback test according to a specific variation of the present invention.

The various components will be controlled through interaction with the fine tuning controller 106 (not shown). The hearing aid 200 comprises a test signal generator 201, a memory 202, a feedback estimator 203 and a feedback suppression filter 204. The feedback suppression filter 204 is not an adaptive filter. However, in variations the feedback suppression filter 204 may be adaptive and in that case the estimated feedback suppression filter coefficients are just used as a starting point for the adaptive filter.

Consider now a feedback suppression filter vector $h=[h(0), h(1), \ldots h(K-1)]^T$ that represent filter coefficients of the feedback suppression filter 204, an output signal vector $x_n=[x(n), x(n-1), \ldots x(n-K+1)]^T$ that represents at least a part of a feedback test signal (and in the following the terms feedback test signal and output signal vector may therefore be used interchangeably) and an input signal vector $y=[y(0), y(1), \ldots y(N-1)]$ comprising input signal samples measured by the input transducer 104 (for reasons of clarity only one of the hearing aid microphones 104-A and 104-B from FIG. 1 are illustrated in FIG. 2 and given reference 104) in response to the feedback test signal being provided by the output transducer 107.

If the feedback suppression filter 204 is a linear filter, such as a FIR filter, then the desired filtering function may be expressed as:

$$y(n) = \sum_{k=0}^{K-1} h(k)x(n-k) = h^T x_n;$$

and if a multitude of corresponding feedback test signals and measured input signal samples are determined then the input signal vector y may be given as:

$$y=h^T X;$$

wherein $X=[x_0, x_1 \ldots x_{N-1}]$ and wherein X in the following may be denoted the output signal matrix. It follows directly that the output signal matrix is formed by horizontal concatenation of N output signal vectors and according to the present variation each of the output signal vectors represent at least a part of the feedback test signal.

Now, the above equations represent the ideal case where the optimum filter coefficient vector is known. However, in reality an estimate of this optimum filter coefficient vector need to be determined and this can be done by minimizing the squared error E between the estimated input signal samples $\hat{y}(n)$, provided by the estimated filter coefficient vector $\hat{h}$, and the real input signal samples y(n):

$$E = \frac{1}{2}\sum_{n=0}^{N-1}(y(n)-\hat{y}(n))^2 = \frac{1}{2}\sum_{n=0}^{N-1}\left(y(n)-\hat{h}^T x_n\right)^2;$$

Wherefrom the estimated filter coefficient vector $\hat{h}$ may be determined:

$$\frac{\partial E}{\partial \hat{h}} = \sum_{n=0}^{N-1}\left(y(n)-\hat{h}^T x_n\right)x_n = 0; \leftrightarrow \hat{h} = \left(XX^T\right)^{-1}Xy^T;$$

Wherein $XX^T$ is the autocorrelation matrix for the output signal vector $x_n$ and wherein $Xy^T$ is a cross correlation between the output and input signal vectors.

The output signal vector $x_n$ and hereby also the output signal matrix X are selected and therefore known in advance, whereby the inverse autocorrelation matrix $(XX^T)^{-1}$ may be calculated off-line and stored in the memory 202 of the hearing aid 200. Preferably the output signal vector $x_n$ is also stored in the memory of the hearing aid 200, whereby the feedback test signal need not be streamed from an external device and to the hearing aid because the hearing aid is capable of generating the desired feedback test signal internally based on the stored output signal vector $x_n$. Thus, the hearing aid 200 is configured to, in response to a trigger event, activate the test signal generator 201 in order to provide the feedback test signal through the output transducer 107. However, in a variation the feedback test signal may be generated internally in the hearing aid 200 and in this case the hearing aid is adapted to calculate the inverse autocorrelation matrix $(XX^T)^{-1}$ internally.

The cross-correlation between the output and input signal vectors may also be determined in a simple manner by the feedback path estimator 203 based on input signal samples y(n) measured in response to a provided feedback test signal.

By having the inverse autocorrelation matrix $(XX^T)^{-1}$ stored in the memory 202 the processing resources and time required to determine the feedback suppression filter coefficients may be reduced compared to previously known methods.

According to an especially advantageous variation the feedback test signal provided by the output signal vector is white noise such as Maximum Length Sequence (MLS) noise. By applying this type of feedback test signal the resulting autocorrelation matrix $XX^T$ becomes a scaled identity matrix and consequently the estimated filter coefficient vector $\hat{h}$ may be determined as:

$$\hat{h}=(P)^{-1}Xy^T;$$

wherein P is a measure of the energy of the known white noise feedback test signal as represented by the output signal vectors. Thus according to this variation it is only required to store the measure of the energy of the feedback test signal instead of the whole autocorrelation matrix of the output signal vector.

It has been found that the estimated filter coefficient vector $\hat{h}$ may be determined with a sufficiently high precision based only on a white noise feedback test signal, so that single test tones can be used, which will improve perceived comfort during the feedback test for at least some users.

Generally, the linear feedback suppression filter 204 may be of any type, such as an IIR filter.

It should be appreciated that the disclosed variations are characterized in that an autocorrelation matrix or a measure derived from the autocorrelation matrix are stored in a memory of a hearing aid whereby the filter coefficients for a feedback suppression filter may be determined independently by the hearing aid as part of a feedback test of short duration.

In the present context, an autocorrelation matrix is construed to cover matrices that primarily consists of elements of the discrete autocorrelation function.

This specific feedback test is particularly attractive for the present invention because the feedback test signal can be very short such that the hearing aid user carrying out the fine tuning will hardly notice that the test is carried out in order to verify hearing aid performance before the change of hearing aid settings is carried out. The feedback test may generally be carried out in less than 3 seconds using this specific feedback test and the duration may be as short as 1 second.

According to still further variations the feedback test may be used to verify that an ear piece is correctly inserted in the ear canal, by comparing the result of the most recent feedback test with a reference value stored in the hearing aid as part of the initial hearing aid fitting, wherein a hearing care professional typically is present to check that the ear piece is positioned correctly in the ear canal.

According to another specific variation the hearing aid performance verification always carries out the feedback test first because a successful feedback test (i.e. a test that does not deviate too much from a predetermined reference) can be used to conclude that the ear piece positioning is correct, that the receiver is not congested by ear wax in a detrimental manner and that the acoustical-electrical input transducers (that may also be denoted microphones) are performing as expected and that as a result hereof these test may be skipped.

According to yet another specific variation a wax congestion test is carried out as disclosed in WO-A1-2016095987, which is hereby incorporated by reference, wherein wax congestion is detected by measuring a shift in resonance frequency of the receiver impedance. However, in further variations other methods for detecting wax congestion may be applied.

According to yet another specific variation a receiver distortion test is carried out as disclosed in WO-A1-2016058637, which is hereby incorporated by reference, wherein receiver distortion is detected if an estimated measure of receiver non-linearity exceeds a predetermined threshold and wherein the estimated measure of receiver non-linearity is based on measuring the electrical impedance of a hearing aid receiver for a given frequency and for a range of different bias voltages applied to the hearing aid receiver. However, alternative methods for detecting receiver distortion may be applied.

Figure 4:
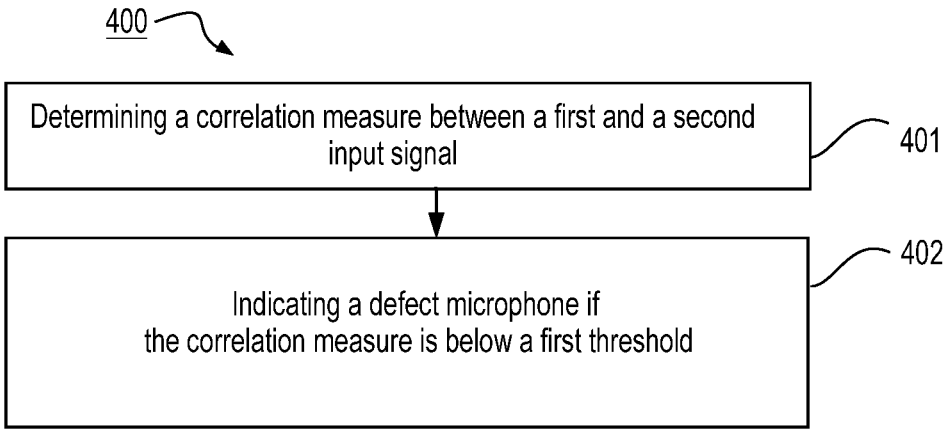
FIG. 4 illustrates highly schematically a method of operating a hearing aid system according to an embodiment of the invention.

According to another variation hearing aid microphone performance is tested (which in the present context may also be denoted monitored). Reference is therefore now made to FIG. 4, which illustrates a method (400) of testing microphone performance of a hearing aid system. The method (400) comprises the steps of:

- in a first step (401) determining a correlation measure between a first and a second input signal at least derived from a first and a second microphone of the hearing aid system, and
- in a second step (402) indicating a defect microphone if the correlation measure is below a first threshold.

According to variations the first and second microphones may be accommodated in the same hearing aid of the hearing aid system or may be accommodated with one microphone in each hearing aid of a binaural hearing aid system or one of the microphones may be accommodated in an external device.

In a more specific variation a first signal level measure is determined for the first and the second input signals, and a microphone is only indicated as defect if the first signal level measure for the first and the second input signals exceed a second threshold wherein the second threshold represents a signal level below which intrinsic and uncorrelated internal microphone noise dominates the input signals.

In a variation it is determined that the input signal with the highest value of a first signal level measure in the low frequency range originates from a defect microphone if both the correlation measure is below the first threshold and if said first signal level measures of the first and second input signal respectively, exceed the second threshold.

According to this specific variation the first signal level measure may be adapted to represent the sound pressure level in a frequency range below 2 kHz or below 500 Hz.

According to another specific variation a second signal level measure is determined for the first and the second input signals, and a microphone is only indicated as defect if the second signal level measure for the first and the second input signals are below a third threshold wherein the third threshold represents a signal level below which wind noise generally does not dominate the input signals.

In further variations the second signal level measure represents the sound pressure level in a frequency range below 2 kHz or below 500 Hz.

The microphone performance test is based on the realization that input signals derived from microphones of a hearing aid system will generally not be uncorrelated unless at least one of the microphones is defect. However, some special cases exist where the input signals will be uncorrelated such as when the sound environment is so quiet that the intrinsic and uncorrelated internal microphone noise dominates the input signals or in case the sound environment is dominated by wind noise that is characterized by providing an uncorrelated and high sound pressure level to the microphones.

Thus, if the signal levels of both input signals are lower than the second threshold representing an upper level of internal microphone noise, then it is concluded that the microphone signals are dominated by the internal microphone noise and as such can't be used to verify the performance and in a similar manner if the signal levels of both input signals are higher than the third threshold representing a lower level of wind noise then it is concluded that the microphone signals are dominated by wind noise and as such can't be used to verify the performance.

According to yet another variation, a microphone may only be indicated as defect if it has been determined that at least one of speech, music and machine noise is present in the sound environment whereby it may be ensured that determination of uncorrelated input signals is not due to neither intrinsic internal microphone noise nor wind noise. Methods for determining respectively speech, music and machine noise are well known in the prior art, such as disclosed e.g. in WO-A1-WO2012076045 and WO-A1-2017059881.

According to a variation the correlation measure is determined based on an approximation of the cross-correlation between the first and the second input signals.

According to a more specific variation, the correlation measure is determined as an approximation to or an estimate of a value r defined by the following equation:

$$r = \frac{\sum XY - \frac{\sum X \sum Y}{N}}{\sqrt{\left(\sum X^2 - \frac{(\sum X)^2}{N}\right)\left(\sum Y^2 - \frac{(\sum Y)^2}{N}\right)}}$$

wherein X is a sampled signal derived from the first input signal, Y is a sampled signal derived from the second input signal, and N is the number of samples.

It is noted that r ranges from −1 to 1 and that r=1 for identical signals X and Y and r=−1 for inverted signals X and Y and r=0 for signals with no mutual correlation.

According to another variation of the present invention, the correlation measure is determined by calculating a particularly simple approximation to the equation wherein the signals X and Y am digitized in one bit words, i.e. the sign of the signals X and Y are inserted in the equation.

According to another variation of the present invention, the correlation measure is determined by calculating a cross-correlation value $r_0$ as a running mean value wherein a predetermined value $\Delta_1$ is added to the sum when sign(X)=sign (Y) and wherein a predetermined value $\Delta_2$ is added to the sum when sign(X)≠sign (Y). If, for example, $\Delta_1=1$, and $\Delta_2=-1$, r increases towards the value "1" when X and Y have identical signs, and r decreases towards the value of "−1" when X and Y have opposite signs. Since non-correlated signals, such as intrinsic microphone noise or wind noise, change sign independently of each other and thus, will have identical signs half the time and opposite signs the other half of the time, then the non-correlated signals will approach a cross-correlation of zero, while signals generated in response to a specific sound source are highly correlated and have the same sign substantially all the time and therefore the cross-correlation will approach 1.

In a specifically advantageous variation the approximation of the cross-correlation between the first and the second input signals comprises a recursive estimation, whereby an effective time averaging is achieved that can improve the approximation of the cross-correlation or similar correlation measure.

According to further variations both the first signal level measure and the second signal level measure is determined based on a L1 norm or an L2 norm. However, in other variations the signal level measures may be percentiles. According to a specific variation the first and the second signal level measures are identical.

It is noted that this method for testing microphone performance is particularly attractive because no test signal is required and consequently the performance can be monitored automatically with a given periodicity without the hearing aid system user even noticing. Thus, according to yet another variation, a performance measure, stored automatically with a given frequency in a memory, can be evaluated in order to ensure that a microphone is only indicated as defect if a multitude of microphone performance test results have indicated it. Furthermore, according to a more specific variation the multitude of microphone performance test results may be used to ensure that some specific sound environment characteristics, such as e.g. speech and music have been present while at least some of the microphone performance test results were determined, whereby an improved performance test may be obtained by only using the test results were at least some of these specific sound environment characteristics were present.

Additionally, it is noted that contemporary hearing aid systems often are configured to determine a correlation measure between two hearing aid system microphone signals for some other purpose than microphone performance verification and that consequently the processing resources required for carrying out the verification test are relatively small. As one example a correlation measure is used in the adaptive wind noise suppression system disclosed in EP-B1-2454891.

Figure 5:
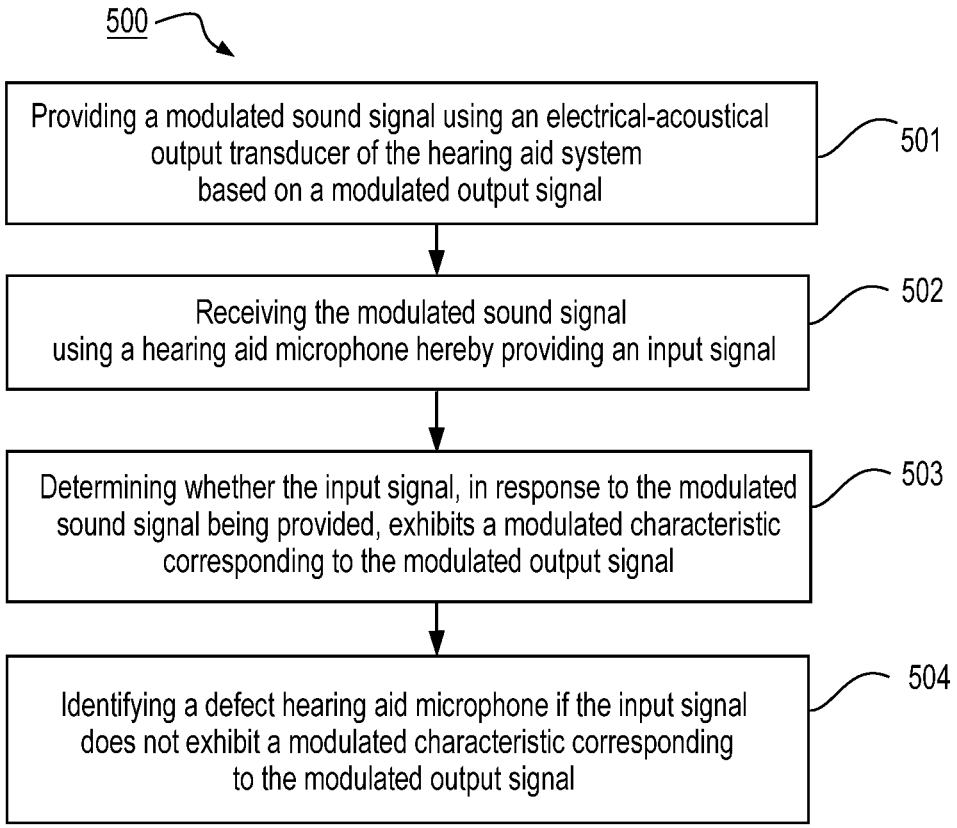
FIG. 5 illustrates highly schematically a method of operating a hearing aid system according to an embodiment of the invention.

According to a further variation an alternative hearing aid system microphone performance test is applied, that is advantageous, for one reason, because it doesn't require at least two microphones. Reference is therefore now made to FIG. 5, which illustrates the method steps (501, 502, 503 and 504) for carrying out the microphone performance test (500). The method is carried out by:

in a first step (501) providing a modulated sound signal using an electrical-acoustical output transducer of the hearing aid system based on a modulated output signal;

in a second step (502) receiving the modulated sound signal using a hearing aid microphone and hereby providing an input signal;

in a third step (503) determining whether the input signal in response to the modulated sound signal being provided, exhibits a modulated characteristic corresponding to the modulated output signal, and in a final step (504) identifying a defect microphone if the input signal does not exhibit a modulated characteristic corresponding to the modulated output signal.

In the present context the term hearing aid system microphone performance test may also be denoted hearing aid microphone performance test since the test is primarily directed at testing microphones accommodated in the hearing aids. However, in variations microphones accommodated in an external device may also be tested using the disclosed method.

According to some possible variations the modulated output signal is a sequence of maximum length sequence pulses or a sine sweep.

According to a more specific variation, a defect microphone is identified if a correlation measure between the input and output signals is below a pre-determined threshold.

According to an even more specific variation, the correlation measure between the input and output signals is determined based on an approximation of the cross-correlation between the first and the second input signals.

In further specific variations the approximation of the cross-correlation is determined using the methods already disclosed above in connection with determining the cross-correlation between the two input signals.

Furthermore, it is noted that these methods of microphone performance test based on a modulated sound signal are advantageous in so far that they allow determination of which one out of a plurality of microphones that are defect, while the previously described methods that are based on monitoring the correlation between at least two microphones only provides an indication that at least one of the plurality of microphones are defect. Thus according to an especially advantageous variation the modulated sound signal test is carried out in response to the previously described method based on the correlation between the input signal indicating that at least one of the hearing aid microphones are defect.

It is noted that the modulated sound based methods are flexible in that the sound may be provided either by a hearing aid or an external device electrical-acoustical output transducer.

However, in variations of the present invention any alternative method for carrying out any of the above mentioned hearing aid performance tests may be applied.

Furthermore, it is noted that while the above mentioned microphone performance tests are disclosed in the context of requiring a hearing aid performance verification before fine tuning a hearing aid system, then these test are also advantageous outside this context, i.e. in their own right. Thus according to one use case the user may initiate the microphone performance test at any point in time in response to e.g. a perceived decrease in hearing aid performance and according to another use case a hearing care professional may initiate from a remote computer the microphone performance test in response to e.g. receiving complaints over the hearing aid system performance from the user. In yet another use case a service provider such as a hearing aid system manufacturer may set up a system wherein microphone performance tests are carried out with regular intervals in order to prevent the user from experiencing long periods with decreased hearing aid system performance.

According to further variations the trigger signal adapted to initiate the performance verification is received from a remote fitting computer or remote server using the internet. The trigger signal may be received directly by the hearing aids or by an external device of the hearing aid system or it may be received by the hearing aid using the external device as gateway. These variations are particularly attractive because they allow a remote hearing care professional to verify that the hearing aid system is performing as expected before suggesting new digital signal processor settings that is unlikely to lead to improved performance if the hearing aid system is not performing as expected. Hereby, the user will experience that the quality of the provided remote service is improved. Furthermore, the verification of hearing aid system performance prior to suggesting new digital signal processor settings as part of remote fine tuning, will improve significantly the value of the data to be used in various big data contexts, such as improving the first fit (i.e. initial setting of the hearing aid parameters) and suggesting new alternative parameter settings in response to complaints or personal preferences of the hearing aid system user or in response to the hearing aid system detecting a specifically challenging sound environment.

Figure 3:
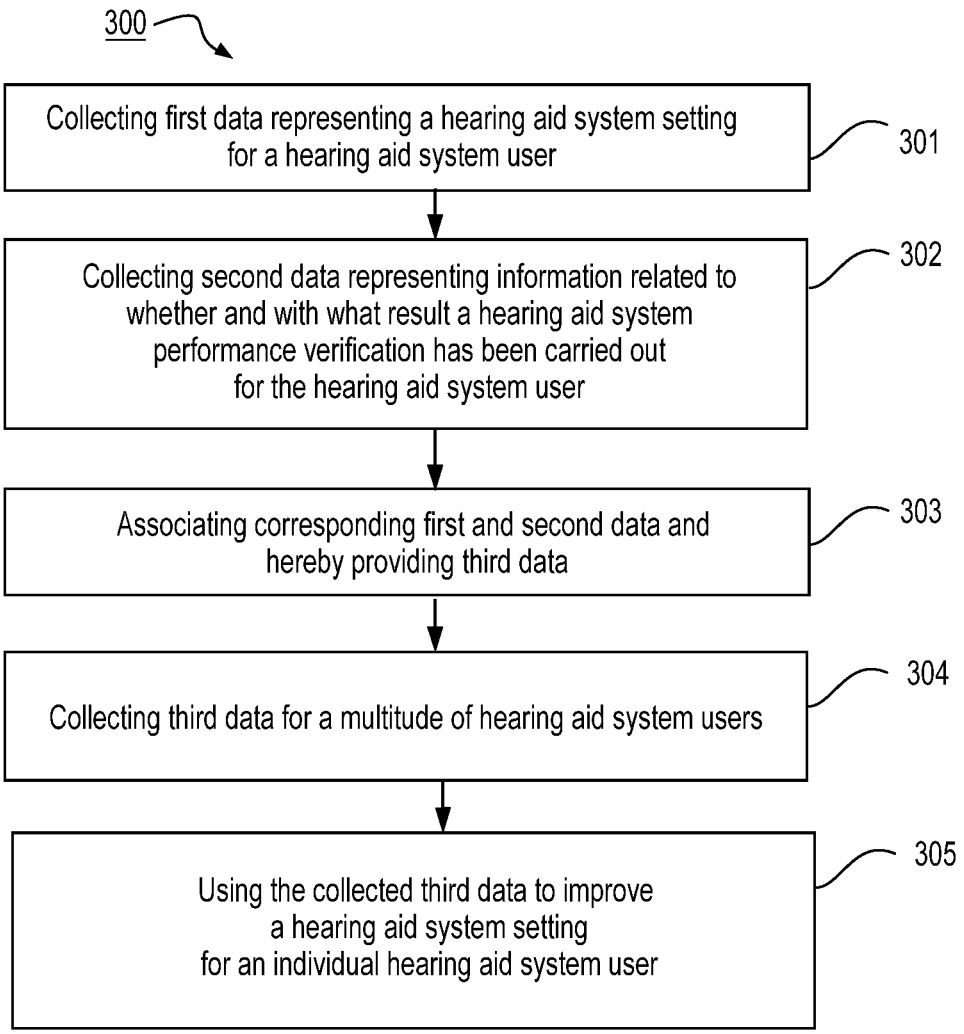
FIG. 3 illustrates highly schematically a method of fitting a hearing aid system according to an embodiment of the invention.

Reference is now made to FIG. 3, which illustrates a method (300) of fitting a hearing aid system according to an embodiment of the invention.

In a first step (301) first data representing a hearing aid system setting for a hearing aid system user is collected.

In a second step (302) second data representing information related to whether and with what result a hearing aid system performance verification has been carried out for the hearing aid system user is collected.

In a third step (303) corresponding first and second data are associated and hereby third data is provided.

In a fourth step (304) collecting third data for a multitude of hearing aid system users. In the final and fifth step (305) using the collected third data to improve a hearing aid system setting for an individual hearing aid system user.

Thus, the improved setting may be provided for a hearing aid system user who may or may not have been among said multitude of hearing aid system users from whom the third data has been collected.

In variations the hearing aid system is connected to the internet directly from the hearing aids or from the external device (typically a smart phone) or is connected to the internet using a smart phone as gateway.

In a further variation the third data is initially stored in the hearing aid system and then at some later point in time transmitted to a remote service provider, such as a hearing aid fitter or a hearing aid system manufacturer, where the third data is stored together with third data from other hearing aid system users and subsequently used to improve a hearing aid system setting for an individual user based on big data analysis. In another variation the first data is transmitted to the hearing aid system from a hearing aid system service provider in order to change the hearing aid system setting, and in this case only the second data is transmitted back to the service provider where the first and second data are associated and subsequently stored.

In a mom specific variation the association (i.e. the linking or pairing) of corresponding first and second data comprises the further step of: determining that the first and the second data are corresponding when the first data represents a new hearing aid system setting that has been changed from its previous setting in response to a hearing aid system performance verification being carried out.

Thus according to the various variations of the present embodiment the step of collecting first data representing a hearing aid system setting for a hearing aid system user may be carried out in a multitude of different manners.

If e.g. the first data represents a new hearing aid system setting, that is the result of a fine tuning carried out by the user, using typically an external device, such as a smart phone, then the first data need to be actively transmitted from the hearing aid system and to the remote service provider in order to be part of the subsequent big data analysis.

If on the other hand the first data represents a new hearing aid system setting, that is provided from the remote service provider, in response to e.g. a complaint about the hearing aid system performance from the hearing aid system user or in response to a request for a new hearing aid system setting that is specifically adapted to a particular sound environment from the hearing aid system user then first data is already known by the remote service provider and consequently no first data needs to be transmitted from the hearing aid system.

In an even more specific variation a hearing aid system performance verification is required in order to change a hearing aid system setting. However, it may be that not all hearing aid systems wherefrom data is collected is set up to require a hearing aid system performance verification before allowing a change of hearing aid system settings or it may be voluntarily whether the user wants to carry out the performance verification and consequently it is also advantageous to collect second data that only provides the information that a hearing aid system verification has not been carried out because this, according to one variation, will allow the first data to be weighted based on whether or not a verification has been carried out.

According to a very specific variation third data is simply not included in the big data analysis if the second data reveals that a hearing aid system performance verification has not been carried out.

According to an alternative variation it may be advantageous in itself to collect the second data representing information related to whether and with what result a hearing aid system performance verification has been carried out (i.e. also without collecting the corresponding first data representing a hearing aid system setting) because the second data may be used to characterize the type of hearing aid system user.

In a variation of the present embodiment the improved hearing aid system setting is provided based on the collected third data from a multitude of hearing aid system users by carrying out the steps of: identifying a multitude of hearing aid system setting clusters based on the collected third data, and using the clusters to at least one of: improving an initial hearing aid setting for an individual hearing aid system user, and offering at least one new hearing aid system setting for an individual in response to a trigger event.

In more specific variations the trigger event is selected from a group of trigger events comprising identification of a specific sound environment, identification of a specific location, a user input and a request from a remote service provider.

In further variations the methods and selected parts of the hearing aid system according to the disclosed embodiments may also be implemented in systems and devices that are not hearing aid systems (i.e. they do not comprise means for compensating a hearing loss), but nevertheless comprise both acoustical-electrical input transducers and electro-acoustical output transducers. Such systems and devices are at present often referred to as hearables. However, a headset is another example of such a system.

In still other variations the invention is embodied as a non-transitory computer readable medium carrying instructions which, when executed by a computer, cause the methods of the disclosed embodiments to be performed.

Other modifications and variations of the structures and procedures will be evident to those skilled in the art.

The invention claimed is:

1. A method (300) of fitting a hearing aid system comprising the steps of:

collecting first data (301) representing a hearing aid system setting for a hearing aid system user;

collecting second data (302) representing information related to whether and with what result a hearing aid system performance verification has been carried out for the hearing aid system user;

associating (303) corresponding first and second data and hereby providing third data;

collecting third data (304) for a multitude of hearing aid system users;

using the collected third data to improve a hearing aid system setting (305) for an individual hearing aid system user;

wherein the step of carrying out a hearing aid system performance verification involves carrying out at least one of a feedback test, a wax congestion test, a microphone performance test, a receiver distortion test and an ear piece positioning test; and wherein the step of using the collected third data to improve a hearing aid system setting for an individual hearing aid system user comprises the further steps of:

identifying a multitude of hearing aid system setting clusters based on the third data;

using the clusters to at least one of:

improving an initial hearing aid setting for an individual hearing aid system user, and offering at least one new hearing aid system setting for an individual hearing aid system user in response to a trigger event.

2. The method according to claim 1, wherein the step of associating corresponding first and second data and hereby providing third data comprises the step of:

determining that the first and the second data are corresponding when the first data represents a new hearing aid system setting that has been changed from its previous setting in response to a hearing aid system performance verification being carried out.

3. The method according to claim 2, wherein a hearing aid system performance verification is required in order to change a hearing aid system setting.

4. The method according to claim 1, wherein the trigger event is selected from a group of trigger events comprising identification of a specific sound environment, identification of a specific location, a user input and a request from a remote service provider.

5. A non-transitory computer-readable medium storing instructions thereon, which when executed by a computer perform the following method steps:

collecting first data (301) representing a hearing aid system setting for a hearing aid system user;

collecting second data (302) representing information related to whether and with what result a hearing aid system performance verification has been carried out for the hearing aid system user;

associating (303) corresponding first and second data and hereby providing third data;

collecting third data (304) for a multitude of hearing aid system users;

using the collected third data to improve a hearing aid system setting (305) for an individual hearing aid system user; and wherein the step of carrying out a hearing aid system performance verification involves carrying out at least one of a feedback test, a wax congestion test, a microphone performance test, a receiver distortion test and an ear piece positioning test; and wherein the step of using the collected third data to improve a hearing aid system setting for an individual hearing aid system user comprises the further steps of:

identifying a multitude of hearing aid system setting clusters based on the third data;

using the clusters to at least one of:

improving an initial hearing aid setting for an individual hearing aid system user, and offering at least one new hearing aid system setting for an individual hearing aid system user in response to a trigger event.

6. The non-transitory computer-readable medium of claim 5, wherein the step of associating corresponding first and second data and hereby providing third data comprises the step of:

determining that the first and the second data are corresponding when the first data represents a new hearing aid system setting that has been changed from its previous setting in response to a hearing aid system performance verification being carried out.

7. The non-transitory computer-readable medium of claim 6, wherein a hearing aid system performance verification is required in order to change a hearing aid system setting.

8. The non-transitory computer-readable medium of claim 5, wherein the trigger event is selected from a group of trigger events comprising identification of a specific sound environment, identification of a specific location, a user input and a request from a remote service provider.

* * * * *